US006320302B1

(12) United States Patent
Simon

(10) Patent No.: US 6,320,302 B1
(45) Date of Patent: Nov. 20, 2001

(54) COPPER CORE SIDE WIRE TO CARBON STEEL SHELL WELD AND METHOD FOR MANUFACTURING

(75) Inventor: Garry Gene Simon, Simpsonville, SC (US)

(73) Assignee: Honeywell International Inc., Morristown, NJ (US)

( * ) Notice: Subject to any disclaimer, the term of this patent is extended or adjusted under 35 U.S.C. 154(b) by 0 days.

(21) Appl. No.: 09/228,450

(22) Filed: Jan. 11, 1999

(51) Int. Cl.[7] ..... H01J 13/20
(52) U.S. Cl. ..... 313/141; 313/135; 313/144
(58) Field of Search ..... 313/141, 135, 313/144

(56) References Cited

U.S. PATENT DOCUMENTS

| | | |
|---|---|---|
| 4,970,426 | 11/1990 | Bronchart . |
| 5,210,457 | 5/1993 | Oshima et al. . |
| 5,530,313 | 6/1996 | Chiu . |

FOREIGN PATENT DOCUMENTS

| | | |
|---|---|---|
| 3-149789 | 6/1991 | (JP) . |

*Primary Examiner*—Vip Patel

(57) ABSTRACT

A spark plug is provided having a copper core side wire including a nickel alloy sheath rolled over the end of the copper core. When the side wire is welded to the steel shell of the spark plug, the rolled over portion of the sheath provides enhanced surface area for bonding to the steel shell. Further, a central portion of the copper core is in direct contact with the steel shell for enhanced thermal conductivity.

17 Claims, 2 Drawing Sheets

COPPER CORE SIDE WIRE TO CARBON STEEL SHELL WELD AND METHOD FOR MANUFACTURING

BACKGROUND OF THE INVENTION

1. Technical Field

The present invention generally relates to spark plugs having a copper core side wire, and more particularly, to a spark plug wherein the side wire includes a metal sheath welded to a metal spark plug shell using a novel "roll-over" technique.

2. Discussion

Conventional spark plug side wires, also referred to in the art as ground electrodes or outer electrodes, include solid nickel based embodiments. As illustrated in FIG. 6, conventional solid nickel-based side wires 200 are normally butt welded with a high welding force ranging from 220 to 300 lbs. to the shell 210 of the spark plug 220. As can be seen from the weld profile for such a process, the solid nickel side wire 200 does not penetrate the steel shell 210 of the spark plug 220.

More recently, spark plug side wires have been provided with copper cores in order to enhance thermal conductivity. However, welding such copper core side wires to spark plug shells, which are commonly made from metal such as steel, has been problematic. For instance, U.S. Pat. No. 4,970,426 discloses welding a copper core side wire to the end of the shell with the copper enclosed within the electrode sheath. This technique is used since copper is an electrically highly conductive material which makes it difficult to resistance weld copper directly to steel without causing voids and embrittlement in the copper adjacent to the weld interface.

If the copper core side wire has internal voids and embrittlement, it may easily break off of the metal shell. These problems may also hinder heat transfer and hence fail to keep the firing tip cool to retard erosion (wear) and reduce thermal stress. Although the process of the '426 patent successfully joins the side wire to the spark plug shell, it does not yield optimum thermal conductivity since the copper core does not directly contact the steel shell.

As a further attempt to eliminate the void and embrittlement problem, U.S. Pat. No. 5,210,457 discloses inserting a second core of nickel alloy or iron within the copper core of the side wire and welding that end to the spark plug shell. While somewhat successful, this method also has drawbacks relating to thermal conductivity and complexity.

Still yet another method of welding copper core side wires to spark plug shells is disclosed in U.S. Pat. No. 5,530,313. As illustrated in FIG. 7, the '313 patent discloses a "stake" method of welding wherein the side wire sheath 300 penetrates deeply into the steel shell 310 to provide an anchor for enhancing mechanical strength. The weld profile for such a process shows that the penetrating stakes 320 of the sheath 300 penetrate the shell 310 essentially vertically and do not roll under the copper core 330. While the stake method is effective for joining the side wire to the shell, there is still room for improvement in the art.

In view of the foregoing, it would be desirable to provide a spark plug having a side wire with a copper core surrounded by a metal sheath which partially rolls over the end of the copper core at the weld interface for providing enhanced surface area for bonding and therefore high mechanical strength as well as direct contact between the copper core and the metal shell for enhancing thermal conductivity. It would also be desirable to provide a method of preparing a side wire stock for such a weld and a method for performing the weld.

SUMMARY OF THE INVENTION

The above and other objects are provided by a spark plug with a copper core side wire wherein the elongated copper core is encircled about its side walls or perimeter by a complementary sheath made from a metal such as a nickel-based alloy. The side wire has an open-end wherein the metal sheathing partially rolls over the exposed end of the copper core. As such, the laterally projecting portion of the sheathing overlying the outboard edges of the end of the copper core provides enhanced surface area for bonding to the steel shell of the spark plug thereby enhancing mechanical strength. Further, when the open-end of the copper core side wire is welded to the shell, the central portion of the copper core is in direct contact with the metal shell thereby enhancing thermal conductivity.

Additionally, the present invention includes a process of preparing the side wire for welding to the metal shell. To accomplish this, a piece of copper core side wire stock is pinch-cut using a cutter having a preselected degree of sharpness such that the metal sheath (due to its ductility) is initially rolled over the copper core and is thereafter cut entirely through. In this way, only a central portion of the copper core is exposed at the open end of the side wire while an outboard circumferential edge thereof is overlaid with a rolled over portion of the metal sheath. In a preferred embodiment of the present invention, the rolled over portion of the metal sheath tapers from a maximum thickness at the perimeter of the copper core to a minimum thickness proximate the exposed central portion thereof.

Still further, the present invention includes a process of welding a copper core side wire prepared as described above to the metal shell of a spark plug including the step of welding with a force ranging from about 90 lbs. to about 110 lbs. depending on the size of the side wire. The force is maintained for approximately four alternating current cycles at about 2.25 kiloamps. This process results in the side wire being bonded to the steel shell across a large surface area of the rolled over portion of the metal sheath while a central portion of the copper core is in direct contact with the steel shell in a non-brittle state. Preferably, the welding step ablates a center part of the tapered rolled over portion of the metal sheath adjacent the central portion of the copper core thereby exposing even more of the central portion of the copper core to the metal shell.

BRIEF DESCRIPTION OF THE DRAWINGS

In order to appreciate the manner in which the advantages and objects of the invention are obtained, a more particular description of the invention will be rendered by reference to specific embodiments thereof which are illustrated in the appended drawings. Understanding that these drawings only depict preferred embodiments of the present invention and are not therefore to be considered limiting in scope, the invention will be described and explained with additional specificity and detail through the use of the accompanying drawings in which.

DETAILED DESCRIPTION OF THE PREFERRED EMBODIMENTS

The present invention is directed towards a process for preparing a copper core side wire for welding to a metal shell of a spark plug, a process for welding the copper core side wire to the metal shell, and a spark plug having a copper core side wire welded to its metal shell having high mechanical strength and high thermal conductivity. In accordance with the teachings of the present invention, a pinch-cut is employed to prepare the side wire for welding which results in the nickel-based alloy sheath of the side wire rolling over the end of the copper core at the cut end thereof. Upon welding at a controlled force, power, and time, the side wire is bonded to the shell along a large surface area of the rolled over nickel-based alloy sheath while a substantial amount of copper core is in direct contact with the steel shell in a non-brittle state.

Figure 1:
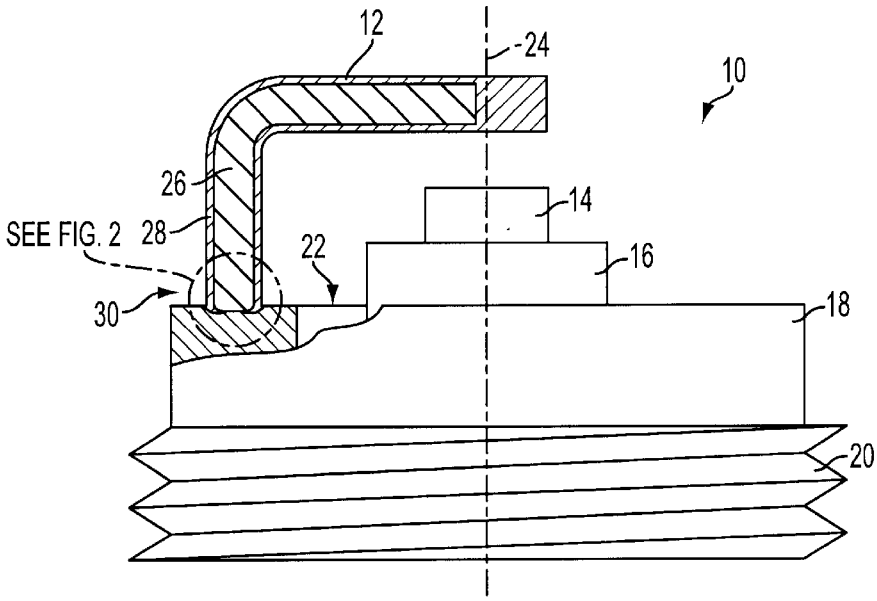
FIG. 1 is a side view in partial cross-section illustrating a copper core side wire welded to a shell of a spark plug in accordance with the present invention.

Turning now to the drawing figures, FIG. 1 illustrates a spark plug 10 with a side wire 12 and a center electrode 14 surrounded by an insulator 16 and metal shell 18 with thread portion 20. The metal shell 18 includes an upper surface 22 extending essentially perpendicularly to a longitudinal axis 24 of the spark plug 10. The side wire 12 includes a copper core 26 surrounded by a metal sheath 28 which may be made from a nickel-based material or alloy such as nickel 592. The side wire 12 has an open end 30 where the copper core 26 is exposed.

Figure 2:
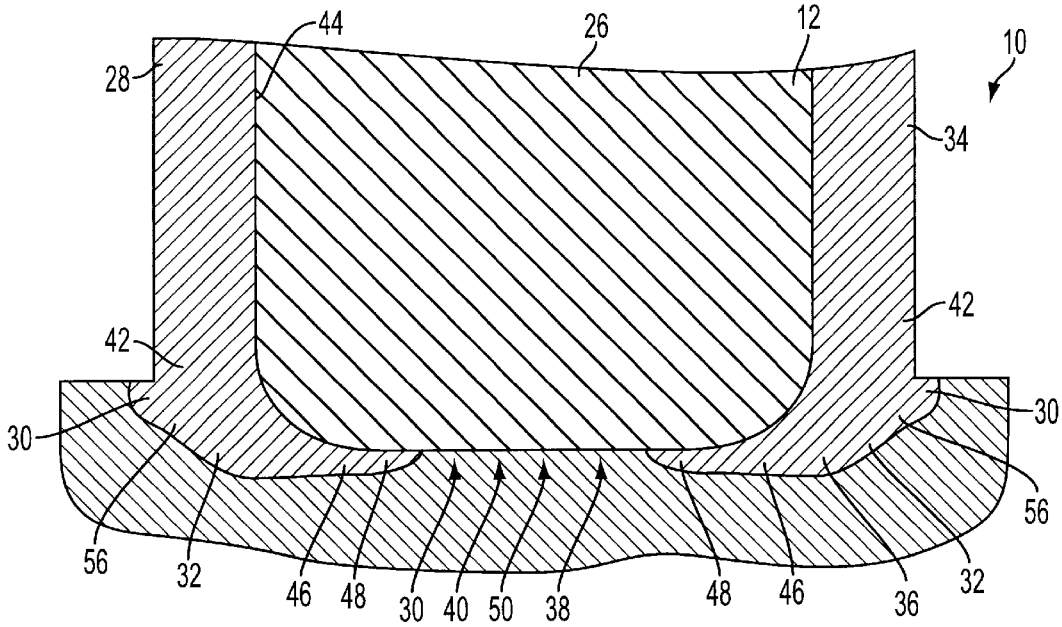
FIG. 2 is a more detailed view in cross-section of the weld profile at the interface of the side wire and shell according to the present invention.

As most clearly illustrated in FIG. 2, the side wire 12 is welded to the metal shell 18, which may be steel 1008, of the spark plug 10. The welding is preferably performed using a welding force ranging from about 90 to about 110 lbs. A preferred method is resistance welding using a transformer with low output amperage, such as 2.0 to 2.50 kiloamps for approximately four cycles. Particularly good welds were achieved using a transformer output amperage of 2.25 kiloamps, four alternating current cycles, and 100 lbs. of force.

The weld profile illustrated in FIG. 2 shows that the metal sheath 28 includes a roll over portion 32 laterally extending from the remaining elongated portion 34 of the metal sheath 28 interposed between the open end 30 of the copper core 26 and the metal shell 18. The roll over portion 32 forms a donut shaped end cap 36 over the end 30 of the copper core 26 with a central orifice 38 leaving the central portion 40 of the copper core 26 exposed. The roll over portion 32 provides a large surface area for bonding to the metal shell 18 which yields high mechanical strength. Further, the central portion 40 of the copper core 26 is bonded to and is in direct contact with the metal shell 18 which yields high thermal conduction of heat from the side wire 12 to the metal shell 18. The improved heat conduction or cooling of the side wire 12 provides for longer service life due to reduced thermal stress.

The weld profile also illustrates that the roll over portion 32 tapers from a maximum cross-sectional width at its perimeter 42 adjacent an outboard edge 44 of the side wire 12 to a minimum cross-sectional width at an inner edge 46 proximate the central portion 40 of the copper core 26. Prior to welding, the roll over portion 32 may completely enclose the copper core 26. However, during welding a center section 48 of the tapered roll over portion 32 near the central portion 40 of the copper core 26 is ablated (i.e., destroyed) thereby exposing more surface area of the copper core 26 to the metal shell 18. Further, the exposure of the copper core 26 to the metal shell 18 during welding causes copper atoms of the copper core 26 and steel atoms of the metal shell 18 to migrate across the interface 50 to form an admixture. This further enhances thermal conductivity and mechanical strength.

Figure 3:
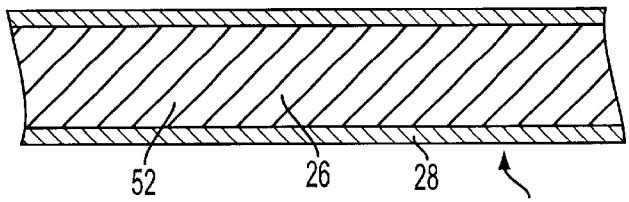
FIG. 3 is a cross-sectional view of a side wire stock prior to pinch-cutting in accordance with the present invention.
Figure 4:
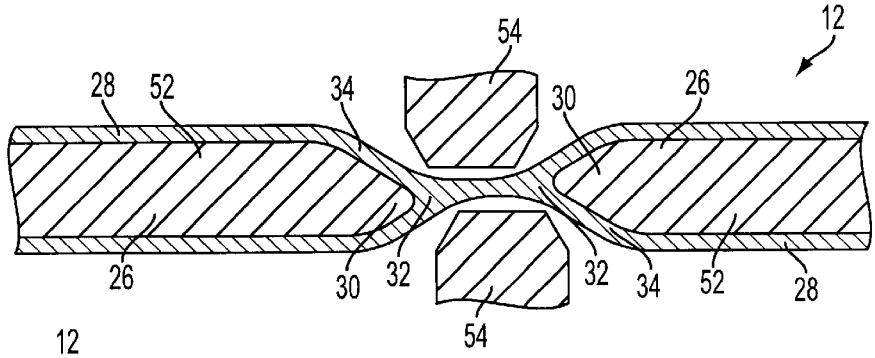
FIG. 4 is a cross-sectional view of the side wire stock during a pinch-cutting process according to the present invention.
Figure 5:
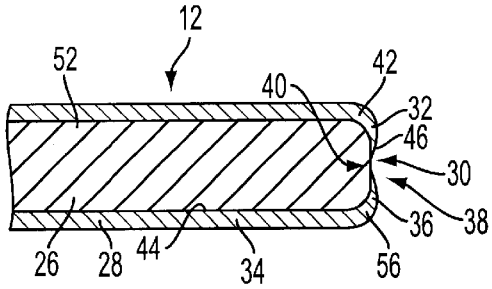
FIG. 5 is a cross-sectional view of the side wire after the pinch-cutting process of the present invention.
Figure 6:
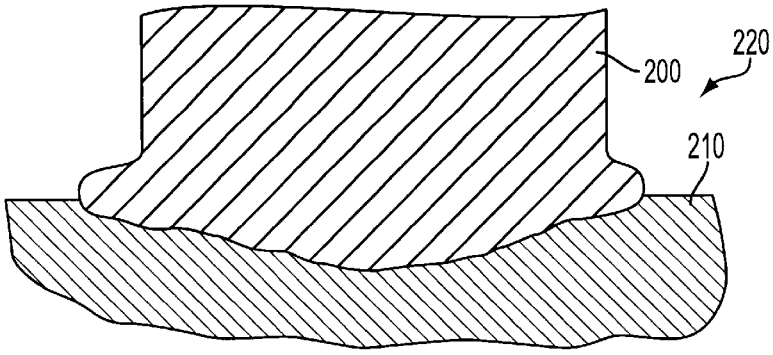
FIG. 6 (PRIOR ART)
FIG. 6 is a cross-sectional view illustrating the weld profile for high pressure welding of a conventional solid nickel-based side wire to a metal shell.
Figure 7:
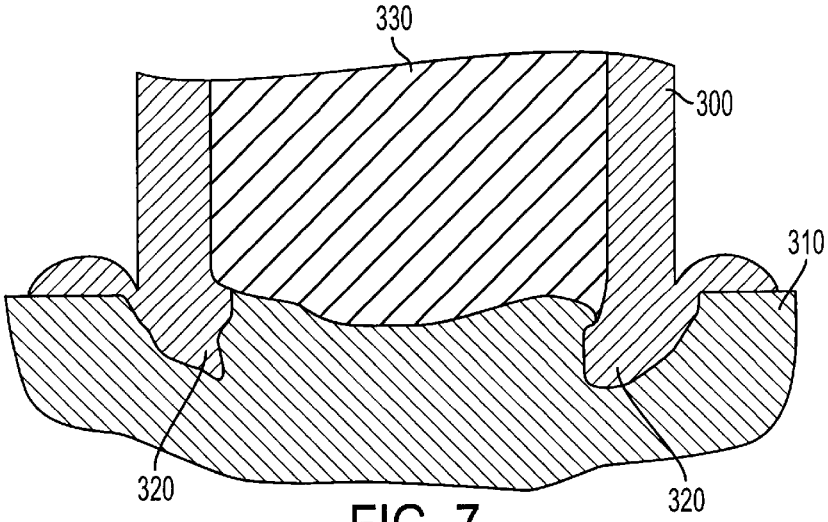
FIG. 7 (PRIOR ART)
FIG. 7 is a cross-sectional view illustrating the weld profile for stake welding a copper core side wire to a metal shell according to the prior art.

Referring now to FIGS. 3–5, a novel method for preparing the side wire 12 for welding so as to yield the roll over portion 32 is illustrated. A piece of side wire stock material 52 is initially provided having a uniform cross-sectional configuration as illustrated in FIG. 3. The stock piece 52 is then pinch cut using a cutter 54 having a predetermined degree of sharpness. The cutter 54 compresses the copper core 26 causing it to retract slightly within the metal sheath 28 as pinching occurs. Further, due to its ductility, the metal sheath 28 rolls over the end 30 of the copper core 26 as illustrated in FIG. 4 to form an arcuate outer surface 56 at a transition area between the inner edge 46 of the metal sheath 28 and the remaining portion 34 of the metal sheath 28 adjacent the sides 44 of the copper core 26. Thereafter, the cutter 54 cuts through the metal sheath 28 yielding the side wire 12 configuration illustrated in FIG. 5 including the tapered roll over portion 32 substantially enclosing the open end 30 of the copper core 26. Due to the rolling over of the metal sheath 28, the roll over portion 32 tapers towards the central portion 40 of the copper core 26.

Thus, the pinch cut process of the present invention prepares a side wire for welding including a tapered roll over portion substantially encompassing an end of a copper core of the side wire. A relatively low force welding process is employed to bond the side wire to the shell of a spark plug such that a large portion of the roll over portion bonds to the metal shell while a substantial surface area of the copper core is in direct contact with the metal shell. Preferably, the welding process ablates part of the tapered roll over portion thereby exposing even more of the copper core to the metal shell.

Those skilled in the art can now appreciate from the foregoing description that the broad teachings of the present invention can be implemented in a variety of forms. Therefore, while this invention has been described in connection with particular examples thereof, the true scope of the invention should not be so limited since other modifications will become apparent to the skilled practitioner upon a study of the drawings, specification, and following claims.

What is claimed is:

1. A spark plug comprising a metal shell; and a side wire having first and second ends connected together by a length of wire, said side wire comprising a metal sheath surrounding a copper core at the first end and axially along the length of wire between the first end and the second end, the second end of said side wire being welded to the metal shell so that the side wire has an end surface at the second end that is substantially perpendicular to the wire's longitudinal axis at the second end and so that the metal sheath partially covers the copper core on said end surface while leaving a central portion of the copper core at said end surface in direct contact with the metal shell.

2. The spark plug of claim 1 wherein the end of the metal sheath is tapered from a perimeter thereof towards the central portion of the copper core.

3. The spark plug of claim 1 wherein the end of the metal sheath extends essentially perpendicularly across the end of the copper core.

4. The spark plug of claim 1 wherein the end of the metal sheath includes an arcuate outer surface at a transition area between the end of the metal sheath and a remainder of the metal sheath.

5. The spark plug of claim 1 wherein the end of the metal sheath forms a donut shaped end cap over the end of the copper core thereby leaving the central portion of the copper core exposed.

6. The spark plug of claim 1 wherein said metal sheath further comprises a nickel alloy.

7. The spark plug of claim 1 wherein said metal shell further comprises steel.

8. A method of welding a copper core side wire to a metal shell of a spark plug comprising:

providing the metal shell with an upper surface extending essentially perpendicularly to a longitudinal axis of the spark plug;

providing the side wire with a metal sheath surrounding the copper core, said side wire having an end surface that is substantially perpendicular to a longitudinal axis of the wire where a portion of said metal sheath at least partially covers said copper core on said end surface; and welding the end of the side wire to the upper surface of the metal shell so that the rolled over portion of the metal sheath bonds to the metal shell while leaving a central portion of the copper core in direct contact with the metal shell.

9. The method of claim 8 wherein said welding step ablates a center section of the rolled over portion of the metal sheath thereby exposing more of the copper core to the metal shell.

10. The method of claim 8 wherein said welding step is executed at a welding force in a range from about 90 to about 110 lbs.

11. The method of claim 8 wherein said welding step further comprises a transformer output amperage of approximately 2.25 kiloamps and approximately four alternating current cycles.

12. The method of claim 8 wherein said metal sheath further comprises a nickel alloy.

13. The method of claim 8 wherein said metal shell further comprises steel.

14. A method of forming a side wire for welding to a metal shell of a spark comprising:

providing a stock piece of side wire including a metal sheath surrounding a copper core; and pinch cutting the stock piece of side wire such that a portion of the metal sheath initially rolls over an end of the copper core and is thereafter cut through.

15. The method of claim 14 wherein said pinch cutting step further comprises tapering the rolled over portion of the metal sheath from its perimeter towards a central section of the copper core.

16. The method of claim 14 wherein said pinch cutting step causes the rolled over portion of the metal sheath to form a donut shaped end cap over the end of the copper core thereby leaving the central section of the copper core exposed.

17. The method of claim 14 wherein said metal sheath further comprises a nickel alloy.

* * * * *